US006669437B2

(12) United States Patent
Yu et al.

(10) Patent No.: US 6,669,437 B2
(45) Date of Patent: Dec. 30, 2003

(54) REGENERATIVE FUEL PUMP WITH LEAKAGE PREVENT GROOVES

(75) Inventors: DeQuan Yu, Ann Arbor, MI (US); Paul E. Fisher, Dexter, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/970,604

(22) Filed: Oct. 4, 2001

(65) Prior Publication Data

US 2003/0068220 A1 Apr. 10, 2003

(51) Int. Cl.[7] ..... F04D 5/00
(52) U.S. Cl. ..... 415/55.1; 415/168.2; 415/169.1
(58) Field of Search ..... 415/55.1–55.7, 415/168.1, 168.2, 169.1

(56) References Cited

U.S. PATENT DOCUMENTS 5,375,971 A 12/1994 Yu ..... 415/55.1
5,415,521 A 5/1995 Hufnagel et al.
5,904,468 A 5/1999 Dobler et al. ..... 415/55.2
5,921,746 A * 7/1999 Yu et al. ..... 415/55.1
6,017,183 A * 1/2000 Dobler et al. ..... 415/55.1

* cited by examiner

*Primary Examiner*—Edward K. Look
*Assistant Examiner*—Dwayne J. White
(74) *Attorney, Agent, or Firm*—Brinks Hofer Gilson & Lione

(57) ABSTRACT

An electric-operated fuel pump has a vaned impeller that is disposed within a pumping chamber for rotation about an axis. The pumping chamber has a main channel extending arcuately about the axis to one axial side of the impeller. The main channel has a radially outer margin that opens along at least a portion of the channel's arcuate extent to an adjoining contaminant collection channel which extends arcuately about the axis and which is effective, as the pumping element rotates, to collect certain fluid-entrained particulates expelled from the main channel and to convey such collected particulates toward the pump outlet. A sump is disposed at the end of the contaminant collection channel proximate the outlet. Several grooves in the seal surface between inlet and outlet, which is called "strip area." The grooves are extended radially outward, the angles match the impeller vane angles and these grooves prevent leakage of the contaminations.

12 Claims, 8 Drawing Sheets

REGENERATIVE FUEL PUMP WITH LEAKAGE PREVENT GROOVES

TECHNICAL FIELD AND BACKGROUND OF THE INVENTION

This invention relates generally to pumps, and in particular to vaned impeller pump useful as an electric-motor-operated fuel pump for an automotive vehicle to pump liquid fuel from a fuel tank through a fuel handling system to an engine that powers the vehicle.

In an automotive vehicle that is powered by an internal combustion engine, fuel that may be pumped through a fuel handling system of the engine by an in-tank, electric-motor-operated fuel pump.

Examples of fuel pumps are shown in various patents, including U.S. Pat. Nos. 3,851,998; 5,310,308; 5,409,357; 5,415,521; 5,551,875; 5,601,308; and 5,904,468. Commonly owned U.S. Pat. Nos. 5,310,308; 5,409,357; 5,551,835; 5,375,971; and 5,921,746 disclose pumps of the general type to which the present invention relates, and such pumps provide certain benefits and advantages over certain other types of pumps. One benefit of such pumps is that a number of its parts may be fabricated from polymeric (i.e. plastic) materials.

Through the continuing development of such pumps, it has been discovered that the presence of certain particulate material in commercial fuel may abrade such synthetic materials and thereby encourage wearing of pump parts made of such materials. Because vanes of a plastic impeller of such a pump are quite small, and because running clearances between pumping chamber walls and such an impeller may also be small, it is believed desirable to reduce the extent of interaction of such particulate material with the internal pumping mechanism. Because an automotive vehicle manufacturer cannot at the present time reasonably rely on commercial fuel refiners to improve fuel purity, is has become incumbent on the vehicle manufacturer to find a solution.

SUMMARY OF THE INVENTION

The present invention relates to a solution for the situation just described. In this invention the or more grooves are provided in the seal surface between inlet and outlet, which is called the "strip area". The grooves extend radially outward, and the length is about the same width as flow channels. The width of the channel is about 1 mm, and the depth of the grooves is about 1.0–1.5 mm. Each groove has a smooth upward ramp to match the vortex path, and reduce flow losses. The shape of the grooves can be flat in the bottom, circular, or elliptical shape.

There are three functions of this invention so called "leakage prevent grooves". They reduce the contact surface of the impeller/cover, and reduce the friction torque; the grooves match the vortex path, clean the contamination in the area, and reduce the chance of wear between impeller/cover. If impeller/cover does wear because of the contamination, the radial directional grooves act like seal grooves and reduce the leakage between inlet/outlet.

Other general and more specific aspects will be set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DETAILED DESCRIPTION OF THE PREFERRED EMBODIMENTS

Figure 1:
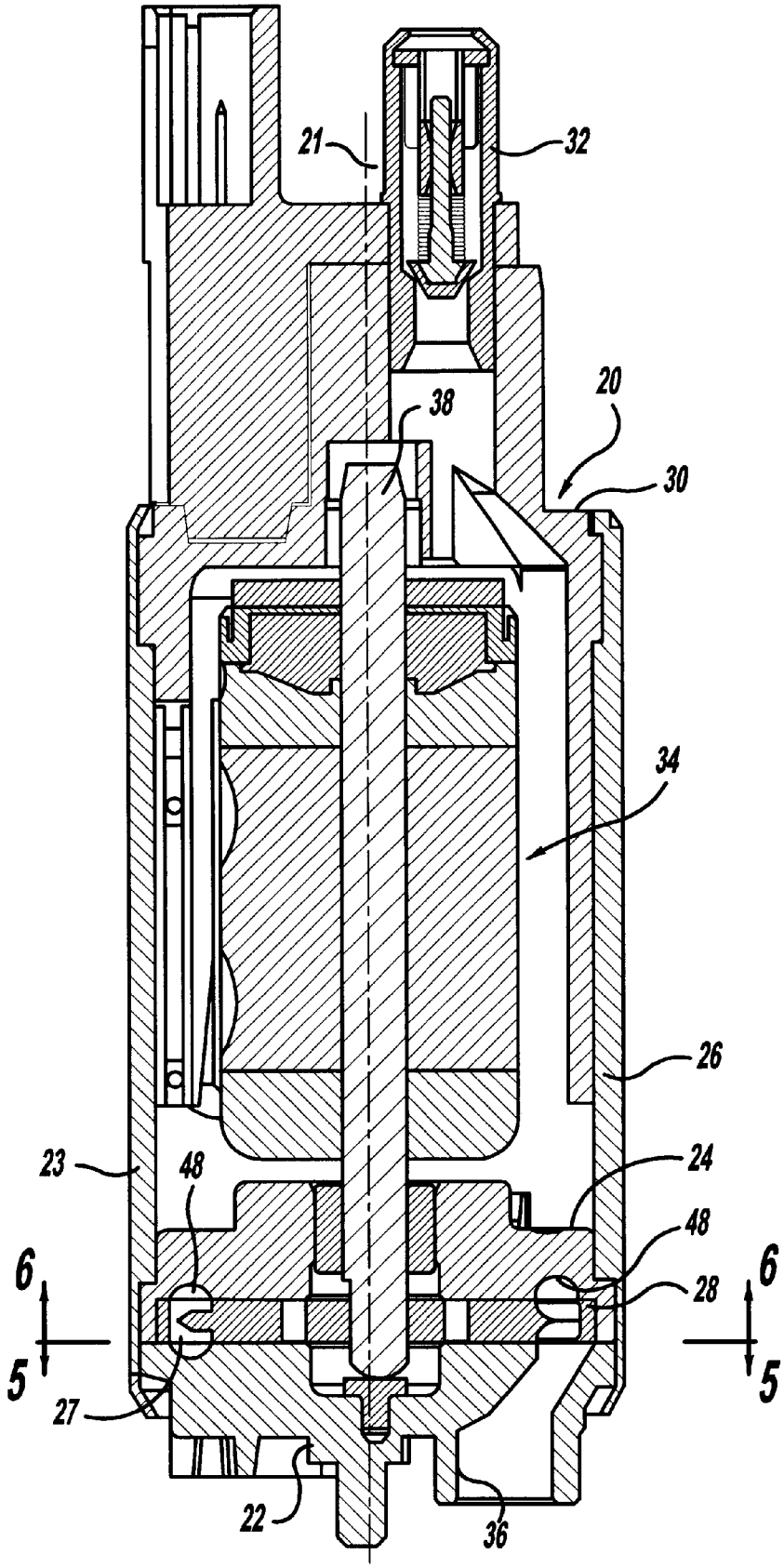
FIG. 1 is a longitudinal cross section view of a fuel pump embodying principles of the invention.

The following description of the preferred embodiments of the invention is not intended to limit the scope of the invention to these three embodiments, but rather to enable any person skilled in the art to make and use the invention.

An automotive vehicle fuel pump 20 embodying principles of the present invention, and having an imaginary longitudinal axis 21, is shown in FIG. 17 to comprise a housing 23 that includes a pump wall 22 and a pump cover 24 cooperatively arranged to close off one axial end of a cylindrical sleeve 26 and to cooperatively define an internal pumping chamber 27 within which a pumping element 28 is disposed for rotation about axis 21. The opposite axial end of sleeve 26 is closed by a part 30 that contains an exit tube 32 via which fuel exits pump 20. Part 30 is spaced from pump cover 24 to provide an internal space for an electric motor 34 that rotates pumping element 28 when pump 20 runs. Motor 34 comprises an armature including a shaft 38 journaled for rotation about axis 21 and having a keyed connection at one end for imparting rotational motion to pumping element 28.

Pump 20 is intended to be at least partially submerged in a fuel tank of an automotive vehicle for running wet. A passage that extends through pump bottom 22 provides an inlet 36 to pumping chamber 27. A passage that extends through pump cover 24 provides an outlet 40 from pumping chamber 27. Fuel that leaves outlet 40 passes through pumping chamber 27. Fuel that leaves outlet 40 passes through motor 34 and exits pump 20 via tube 32 from whence the fuel is pumped to an engine through an engine fuel handling system (not shown).

Figure 2:
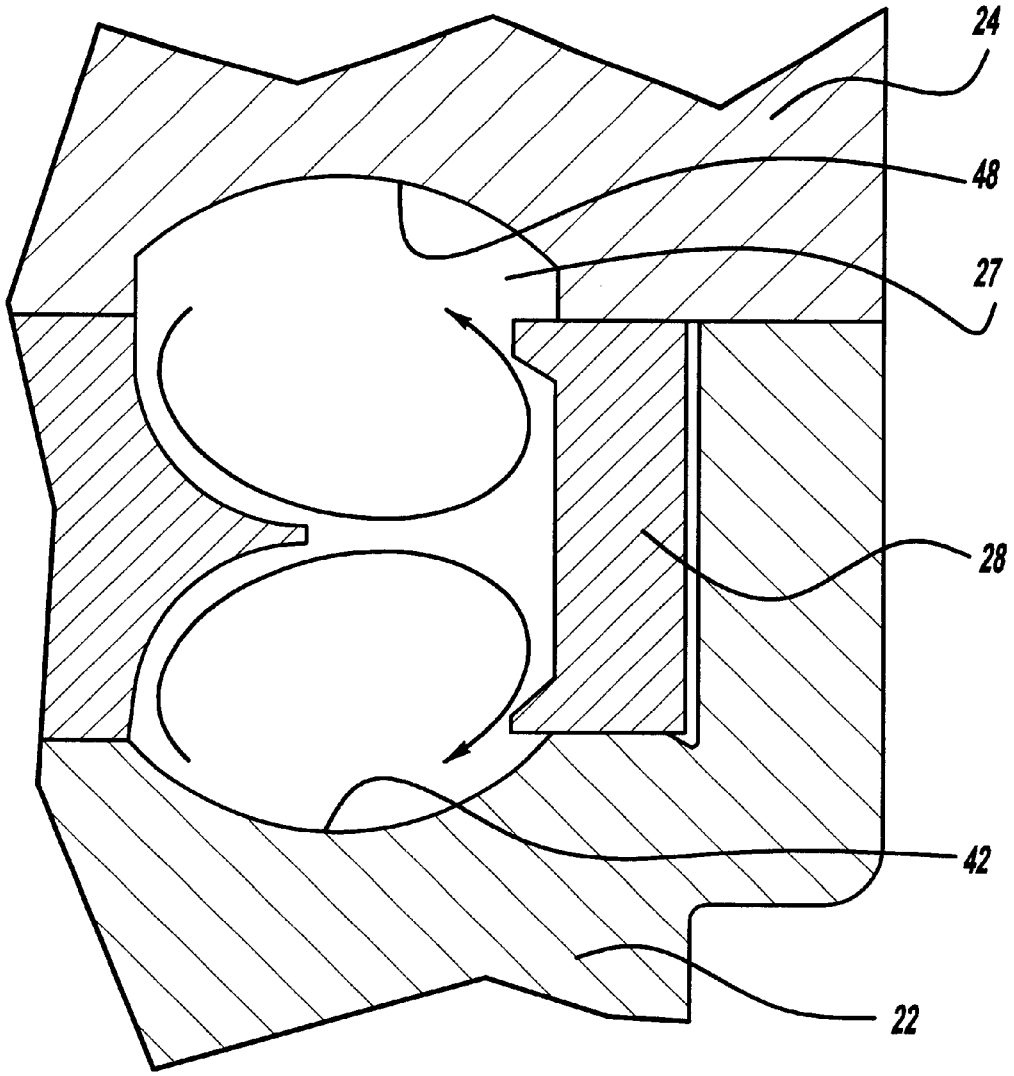
FIG. 2 is an enlarged fragmentary cross sectional view of part of the pumping element and showing the vortex paths.
Figure 3:
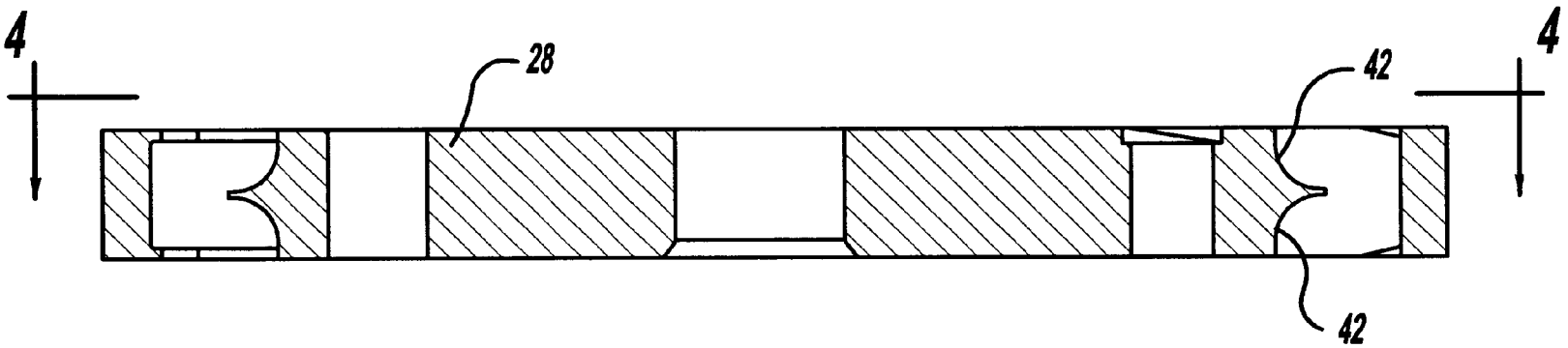
FIG. 3 is an enlarged view of one part of the fuel pump of FIG. 1, namely a vaned pumping element, by itself.
Figure 4:
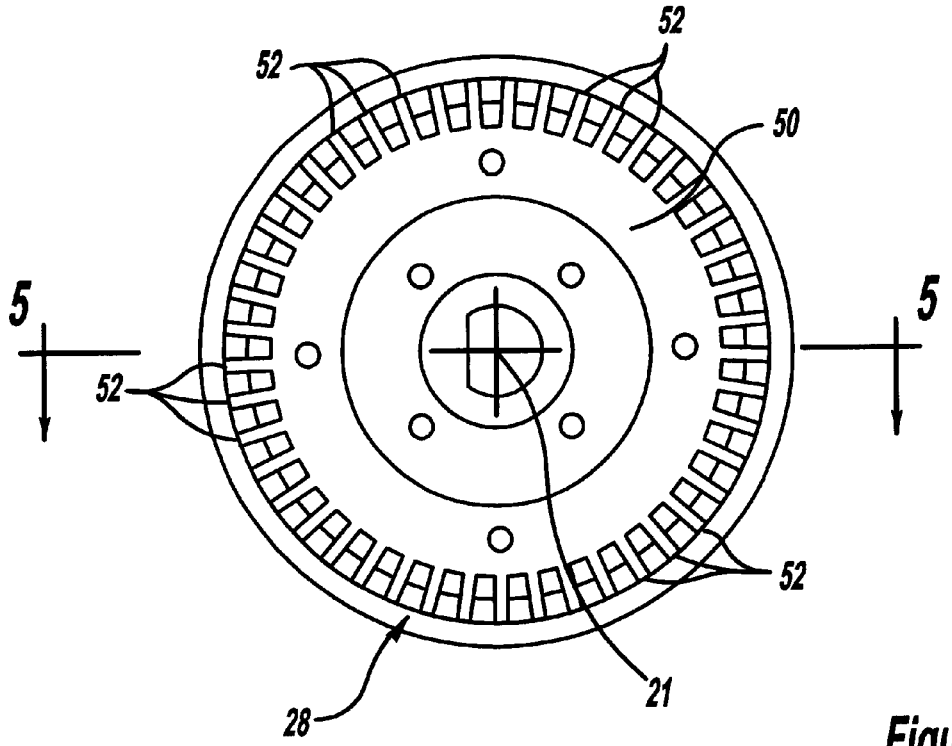
FIG. 4 is a full view of the pumping element in the direction of arrows 4—4 in FIG. 3.
Figure 5:
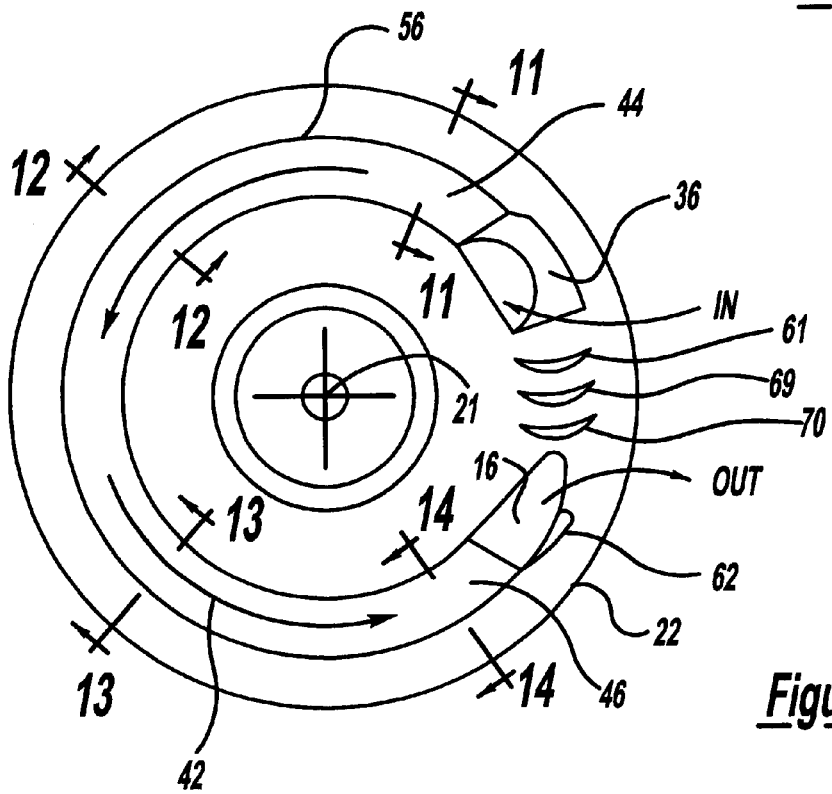
FIG. 5 is an enlarged view in the direction of arrows 5—5 in FIG. 1.
Figure 6:
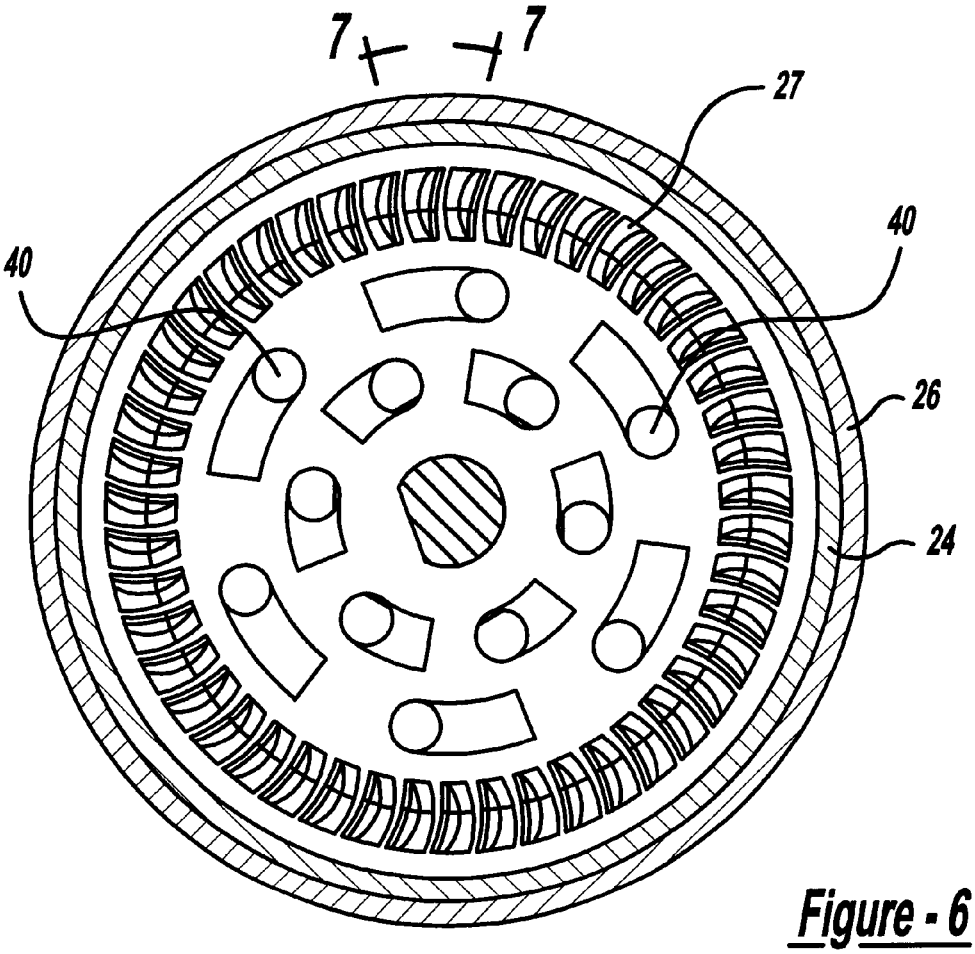
FIG. 6 is an enlarged view in the direction of arrows 6—6 in FIG. 1.
Figure 7:
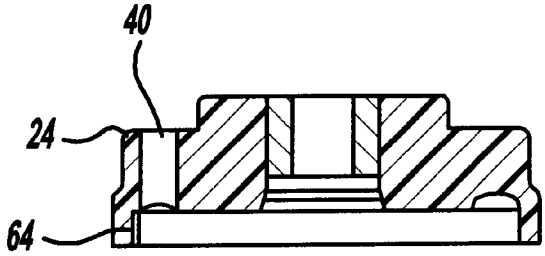
FIG. 7 is a sectional view of the pump as seen from arrows from FIG. 6.

Pumping chamber 27 comprises a main channel 42 as shown in FIG. 5, extending arcuately about axis 21 in pump bottom 22 to one axial side of pumping element 28. As seen in FIG. 5, main channel 42 has a circumferential extent of more than 270°, but less that 360°. From a location 44 immediately proximate inlet 36, to a location 46 immediately proximate outlet 40, main channel 42 is essentially circular, having a substantially constant radial dimension. In radial cross section, main channel 42 is concave, as shown in FIGS. 1, 2, and 3. A further portion of pumping chamber 27 is provided by a main channel 48 formed in pump cover 24 opposite, and similar in geometry to, main channel 42.

Pumping element 28 comprises a circular body 50 having a series of circumferentially spaced apart vanes 52 with a ring around its outer periphery. As pumping element 28 is rotated by motor 34, its vaned periphery is effective to create a pressure differential between inlet 36 and outlet 40 that pushes fluid through tube 30 and motor 34, and forces the fluid out of pump 20 through outlet 32.

In accordance with certain inventive principles, main channel 42 has a radially outer margin that opens along at least a portion of its arcuate extent to an adjoining contaminant collection channel 56 that extends arcuately about axis 21. The open area is designated by the reference numeral 58. In radial cross section, channel 56 is shown to be much smaller than main channel 42. As a pumping element 28 rotates, certain fluid-entrained particulates in fuel moving through the pump are propelled from main channel 42 through the open area 58, presumptively by centrifugal forces. Contaminant collection channel 56 is effective to contain and convey such collected particulates in a direction toward outlet 40. Contaminant collection channel 56 is dimensioned in relation to main channel 42 such that the presence of contaminant collection channel 56 in pump 20 creates no substantial change in pumping efficiency in comparison to a like pump that lacks contaminant collection channel 56.

Beyond location 46, main channel 42 contracts to form an ending section 16 for transitioning the fuel flow toward outlet 40. At the end of the contaminant collection channel 56 proximate outlet 40, a sump 62 is disposed outwardly adjacent ending section 16. Sump 62 is formed by an undercut in the same face of pump bottom 22 that contains contaminant collection channel 56. Sump 62 provides a volume where particulates that have been conveyed to is through channel 56 may collect before they are expelled from pump 20. Because outlet 40 is in pump cover 24, a slot 64 bridges sump 62 to outlet 40 radially outwardly of the periphery of both pumping element 28 and ending section 16. In this way slot 64 provides an escapement for particles to pass from sump 62 to outlet 40 out of the path of the rotating pumping element 28.

Figure 8:
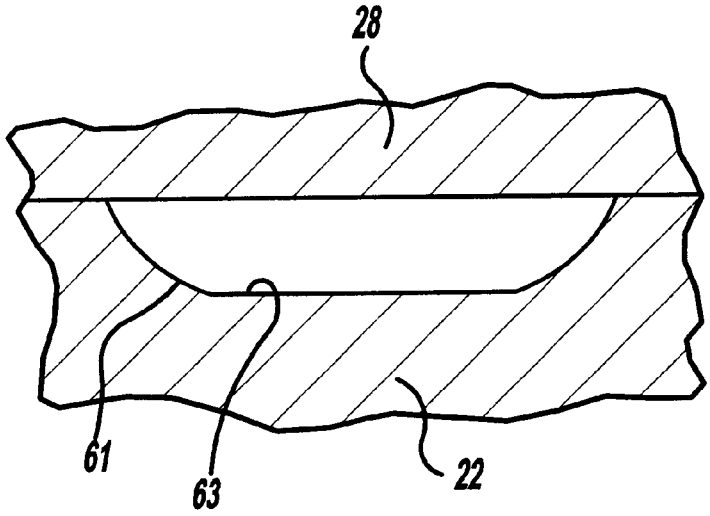
FIGS. 8, 9, and 10 are enlarged views of three different leakage prevent grooves shown in FIG. 5 and FIG. 7.
Figure 9:
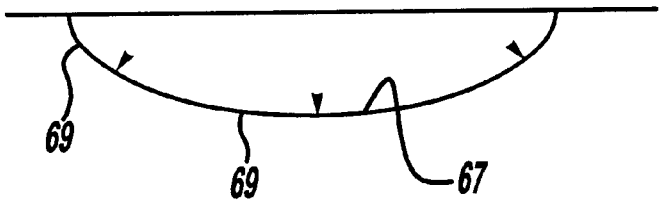
Figure 10:
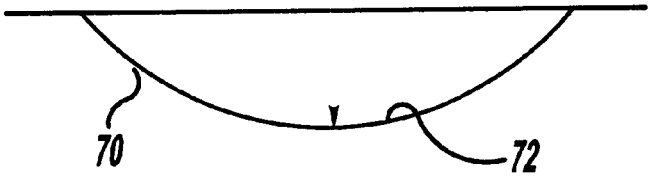
Figure 11:
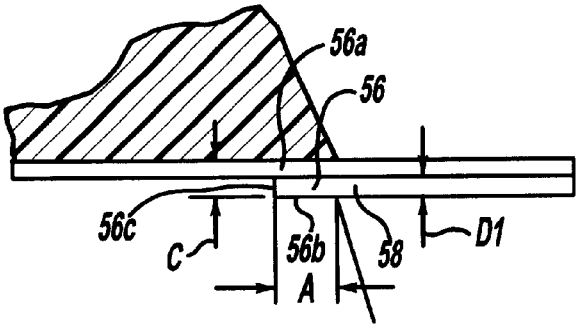
FIGS. 11, 12, 13, and 14 are enlarged fragmentary cross section views taken through a pump at locations respectively represented by sections lines 11—11, 12—12, 13—13, and 14—14 in FIG. 5.
Figure 12:
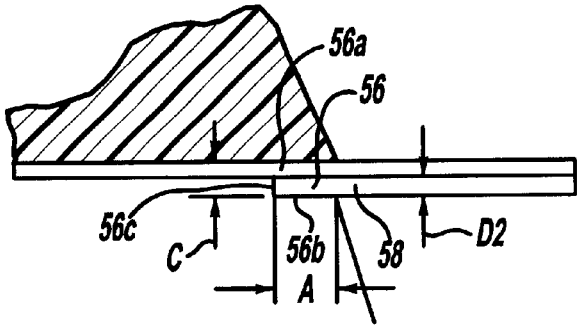
Figure 13:
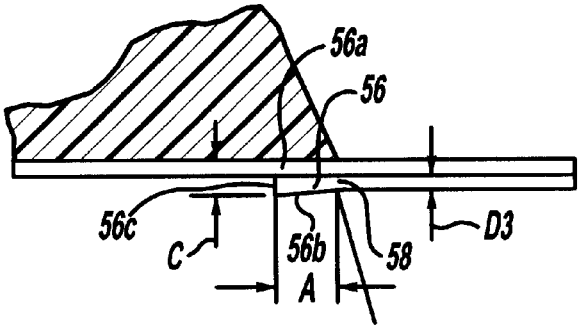
Figure 14:
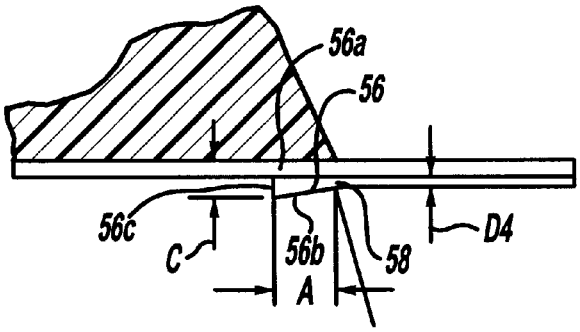

FIGS. 8, 9 and 10 are side elevational cross-sectional views of three different leakage prevent grooves shown in FIG. 5 on the pump bottom 22. There are several grooves laid in the seal surface between the "in" and "out" surface. FIG. 8 shows a groove 61 having a flat bottom 63 and inclined ends 65 that are angled to match the impeller vane angles. The length of the groove 61 is about the same width as the flow channel 42. The width is about 1 mm and depth of the grooves is about 1.0–1.5 mm. At each end of the groove there is a smooth upward ramp to match the vortex path and reduce flow losses. The shape of these grooves could be flattened in the bottom, circular, or elliptical shape.

Figure 15:
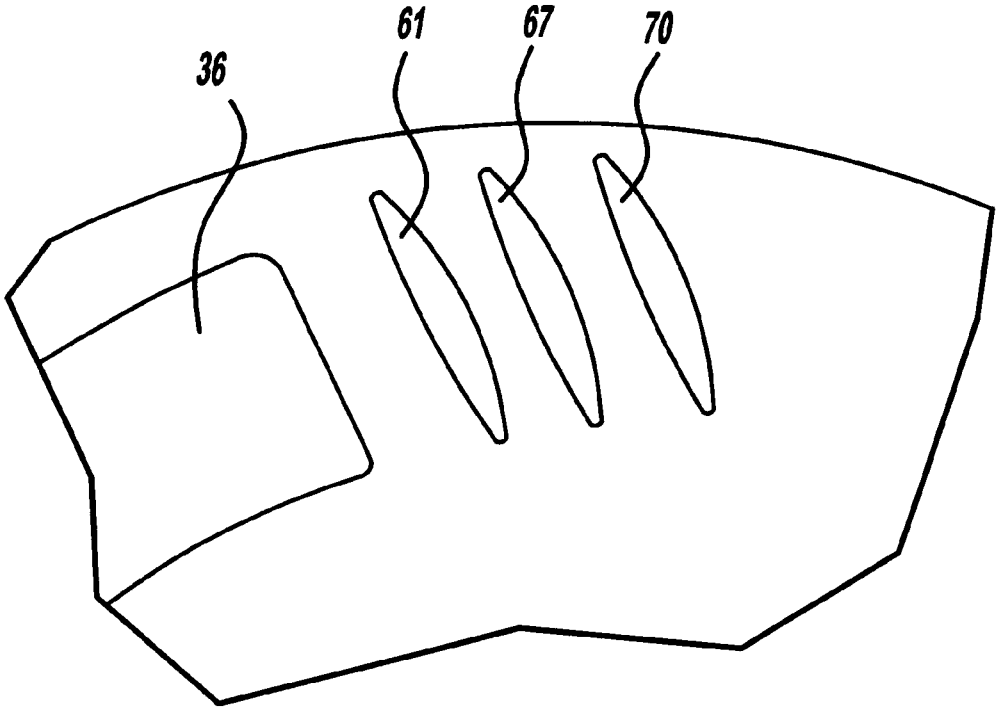
FIG. 15 is an enlarged perspective view of the leakage prevent grooves and their position near the entry to the pump passage.

FIG. 9 shows a groove 67 which has an elliptical bottom 69 and FIG. 10 shows a similar groove 70 which has a circular bottom 72 as described above. It is seen that there are three functions of this invention in providing the "leakage prevent grooves 61, 67, and 70." The grooves 61, 67, and/or 70, as seen in FIG. 15, can be used singly, or in greater number or mixed grooves. First, a groove reduces the contact surface of the impeller/cover and reduces friction torque. Second, each groove matches the vortex path, cleaning the contamination in the area and reducing the chance of wear between impeller and cover surface. If impeller and cover surfaces wear because of the contamination the radial directional grooves act like sealed grooves to reduce the leakage between inlet and outlet.

Contaminant collection channel 56 may, as shown by FIGS. 11–14, be considered to comprise two side wall surfaces 56*a*, 56*b*, and an end wall surface 56*c*. These figures also show a geometry that is believed desirable for aiding containment of particulate matter in channel 56, once such matter has entered the channel. Along an initial portion of channel 56 extending from location 44, wall surfaces 56*a*, 56*b* may be uniformly spaced apart and parallel, making the axial dimension of open area 58 constant. As contaminant collection channel 56 approaches sump 62, wall surfaces 56*a*, 56*b* may depart from parallelism, while retaining flatness. For example, wall surface 56*b* may begin to incline slightly so as to cause a progressive decrease in the axial dimension of open area 58, and a corresponding decrease in cross sectional area of contaminant collection channel 56 as viewed circumferentially of channel 56. It is believed that this gradual constriction aids the containment of particles moving through channel 56 and their eventual expulsion from the pump. Because known flow principles hold that decrease in cross sectional area available for flow creates corresponding increase in flow velocity, it is believed that acceleration is imparted to particles as they move along channel 56, promoting the immediately flushing of particles out of the pump instead of their accumulation in sump 62. Illustrative measurements for dimensions "A", "C" in all of FIGS. 11–14, and for dimensions "D1", "D2", "D3", and "D4" in respective ones of FIGS. 11–14 are as follows: "A"=0.100 mm.; "C"=0.070 mm; "D1"=0.070 mm; "D2"= 0.070 mm; "D3"=0.030 mm; and "D4"=0.010 mm.

It is believed that pumps embodying principles that have been described and illustrated herein can improve pump performance and durability.

The foregoing discussion discloses and describes two preferred embodiments of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology which has been used is intended to be in the nature of words of description rather than of limitation.

What is claimed is:

1. A pump comprising:

a pump housing having an internal pump chamber;

a fluid inlet to, and a fluid outlet from, the pumping chamber spaced arcuately apart about an axis;

a pumping element that is disposed within the housing for rotation about the axis and has a vaned periphery that is operable within the pumping chamber to pump fluid from the inlet to the outlet when the pumping element is rotated, said vaned periphery having angled vanes; the pumping chamber being defined at least in part by a main channel extending within the housing arcuately about the axis to one axial side of the pumping element; the main channel having a radially outer margin that opens along at least a portion of the channel's arcuate extent to an adjoining contaminant collection channel which extends arcuately within the housing about the axis and which is effective, as the pumping element rotates, to collect certain fluid-entrained particulates expelled from the main channel and to convey such collected particulates to the outlet, the contaminant collection channel being arranged and constructed in relation to the main channel such that the presence of the contaminant collection channel in the pump creates no substantial change in pumping efficiency; and at least one leakage prevent groove located between said inlet and said outlet, said leakage prevent groove being angled to substantially match the angled vanes.

2. A pump as set forth in claim 1 wherein a plurality of leakage prevent grooves are located in side-by-side positions between said inlet and said outlet located in paths radially of said axis.

3. A pump as set forth in claim 1 wherein said leakage prevent groove has a flat bottom.

4. A pump as set forth in claim 1 wherein said leakage prevent groove has a circular bottom.

5. A pump as set forth in claim 1 wherein said leakage prevent groove has an elliptical bottom.

6. A pump as set forth in claim 1 wherein said leakage prevent groove is located such that tile distance between said leakage prevent groove and said inlet is approximately equal to the distance between said leakage prevent groove and said outlet.

7. A pump as set forth in claim 1 wherein the width of said leakage prevent groove is approximately 1 mm and the depth of said leakage prevent groove is approximately 1.0–1.5 mm.

8. A pump comprising:

a pump housing having an internal pump chamber;

a fluid inlet to, and a fluid outlet from, the pumping chamber spaced arcuately apart about an axis;

a pumping element that is disposed within the housing for rotation about the axis and has a vaned periphery that is operable within the pumping chamber to pump fluid from the inlet to the outlet when the pumping element is rotated; the pumping chamber being defined at least in part by a main channel extending within the housing arcuately about the axis to one axial side of the pumping element; the main channel having a radially outer margin that opens along at least a portion of the channel's arcuate extent to an adjoining contaminant collection channel which extends arcuately within the housing about the axis and which is effective, as the pumping element rotates, to collect certain fluid-entrained particulates expelled from the main channel and to convey such collected particulates to the outlet, the contaminant collection channel being arranged and constructed in relation to the main channel such that the presence of the contaminant collection channel in the pump creates no substantial range in pumping efficiency; and at least one leakage prevent groove located between said inlet and said outlet, said leakage prevent groove having a bottom surface shape selected from the group consisting of an elliptical bottom surface, a circular bottom surface and a flat bottom surface.

9. A pump as set forth in claim 8 wherein the width of said leakage prevent groove is approximately 1 mm and the depth of said leakage prevent groove is approximately 1.0–1.5 mm.

10. A pump as set forth in claim 8 wherein said leakage prevent groove is located such that the distance between said leakage prevent groove and said inlet is approximately equal to the distance between said leakage prevent groove and said outlet.

11. A pump comprising:

a pump housing having an internal pump chamber;

a fluid inlet to, and a fluid outlet from, the pumping chamber spaced arcuately apart about an axis;

a pumping element that is disposed within the housing for rotation about the axis and has a vaned periphery that is operable within the pumping chamber to pump fluid from the inlet to the outlet when the pumping element is rotated; the pumping chamber being defined at least in part by a main channel extending within the housing arcuately about the axis to one axial side of the pumping element; the main channel having a radially outer margin that opens along at least a portion of the channel's arcuate extent to an adjoining contaminant collection channel which extends arcuately within the housing about the axis and which is effective, as the pumping element rotates, to collect certain fluid-entrained particulates expelled from the main channel and to convey such collected particulates to the outlet, the contaminant collection channel being arranged and constructed in relation to the main channel such that the presence of the contaminant collection channel in the pump creates no substantial change in pumping efficiency; and at least one leakage prevent groove located between said inlet and said outlet such that the distance between said leakage prevent groove and said inlet is approximately equal to the distance between said leakage prevent groove and said outlet.

12. A pump as set forth in claim 11 wherein the width of said leakage prevent groove is approximately 1 mm and the depth of said leakage prevent groove is approximately 1.0–1.5 mm.

* * * * *